US005437065A

United States Patent [19]

Sakawa

[11] Patent Number: 5,437,065

[45] Date of Patent: Aug. 1, 1995

[54] BOOTHS FOR TOILETS

[75] Inventor: Katsuki Sakawa, Ehime, Japan

[73] Assignee: Sakawa Co., Ltd., Ehime, Japan

[21] Appl. No.: 32,271

[22] Filed: Mar. 17, 1993

Related U.S. Application Data

[63] Continuation-in-part of Ser. No. 706,484, May 28, 1991, abandoned.

[30] Foreign Application Priority Data

Jun. 1, 1990 [JP] Japan ..... 2-58367 U

[51] Int. Cl.[6] ..... E03D 1/22

[52] U.S. Cl. ..... 4/342; 4/662; 52/34; 52/282.2

[58] Field of Search ..... 4/342, 460–463, 4/476–478, 340, 342, 662, 663, 449, 596, DIG. 15; 49/40; 52/34, 236.1, 236.2, 236.9, 239, 35, 241, 282.1, 282.3

[56] References Cited

U.S. PATENT DOCUMENTS

| | | | |
|---|---|---|---|
| 819,406 | 5/1906 | Brown | 4/342 |
| 2,208,198 | 7/1940 | Spaman | 49/40 |
| 2,240,482 | 5/1941 | Anderson | 52/34 |
| 2,650,368 | 9/1953 | Evans | 52/34 |
| 2,772,420 | 12/1956 | Carter | 4/342 |
| 3,066,311 | 12/1962 | Thorp | 4/462 |
| 3,349,533 | 10/1967 | Gregoire | 52/282.2 |
| 3,447,167 | 6/1969 | Harding . | |
| 3,452,501 | 7/1969 | Zimmer et al. | 52/282.2 |
| 3,738,083 | 6/1973 | Shimano | 52/282.2 |
| 3,835,480 | 9/1974 | Harding | 4/462 X |
| 3,842,556 | 10/1974 | Brendgord | 52/34 X |
| 4,642,821 | 2/1987 | Zanuso et al. | 4/460 |
| 4,881,353 | 11/1989 | Braendel et al. | 52/239 |
| 4,947,601 | 8/1990 | McGuire | 52/241 |

FOREIGN PATENT DOCUMENTS

| | | | |
|---|---|---|---|
| 0018299 | 10/1980 | European Pat. Off. . | |
| 107227 | 5/1984 | European Pat. Off. | 52/34 |
| 1586838 | 3/1970 | France . | |
| 2260674 | 10/1975 | France | 52/282.2 |
| 3033812 | 4/1982 | Germany . | |
| 8902617 | 5/1989 | Germany . | |
| 224967 | 10/1991 | Japan | 52/34 |
| 3275869 | 12/1991 | Japan | 52/34 |
| 4327657 | 11/1992 | Japan | 52/34 |

*Primary Examiner*—Henry J. Recla
*Assistant Examiner*—Gregory M. Vidovich
*Attorney, Agent, or Firm*—Browdy and Neimark

[57] ABSTRACT

A booth for toilets and others is characterized by curving outward a whole or a part of a door or a perimetric wall, so that an interior space is widened, thereby to lessen an oppressive or tight feelings. Further, the widened space can be effectively utilized and an exterior appearance thereof is improved. A partition and a front plate panel are connected by means of an aluminum frame having a projecting core extending in a vertical direction into an interior wall face of an inserting opening. The front plate panel is line-contacted to the projecting core, so that a slight rotation may be effectuated, and the panel may be installed to a differently shaped wall.

5 Claims, 4 Drawing Sheets

BOOTHS FOR TOILETS

This application is a continuation-in-part of U.S. Ser. No. 07/706,484, filed May 28, 1991, now abandoned, the entire contents of which above-referenced application are incorporated herein by reference.

BACKGROUND OF THE INVENTION

1. Field of the Invention

This invention relates to booths such as toilet booths, shower booths, telephone booths and others not only in houses but also schools, hospitals, public offices, office buildings, department stores, hotels , fitting rooms and the like.

2. Description of the Prior Art

Conventional booths are generally square, and perimetric walls comprise flat plates. Further, wall faces for installing the booths are also flat.

In urban communities, there have recently been not few cases that buildings are constructed in narrow deformed spaces which are not regularly readjusted in square. In such cases, for making efficient use of lands without being useless, the buildings cannot help being constructed in accordance with land shapes. Subsequently, angled or cornered wall faces or curved face walls appear, and those are difficult to utilize. The existing square booths, in particular, a plurality of adjoining booths, as shown in FIG.6, create gaps and spoil exterior appearances thereof, so that it is difficult to install them there.

In addition, the conventional booths have not been satisfactorily spacious. For example, when seating on a toilet seat, the door, the perimeter wall panels and a user's body come close to each other due to his posture, so that he often has an oppressive or tight feeling together with a limiting feeling within the booth. Further, since it is required to install lots of toilets within a limited space, the interior of each booth have been small.

SUMMARY OF THE INVENTION

Thus, it is an object of the present invention to provide a number of booths for the toilets in spaces having walls which abut at different angles.

It is another object of this invention to provide a booth for the toilets and others which may widen an interior space, lessening the oppressive or tight feelings and creating comfortableness.

It is a further object of the invention to provide a booth for the toilets and others which may effectively utilize the widened interior space, and realizing beautiful effects on an exterior appearance thereof.

Other and further objects, features and advantages of this invention will appear more fully from the following description.

The present invention is directed to booths for toilets and others, wherein the door or the front panel and the door of the booth are curved outwardly, and enabling partitions (side panels) to be positioned at selected angles to the front panel and the door.

DESCRIPTION OF THE PREFERRED EMBODIMENTS

Preferred embodiments of this invention will be explained with reference to the attached drawings.

Figure 1:
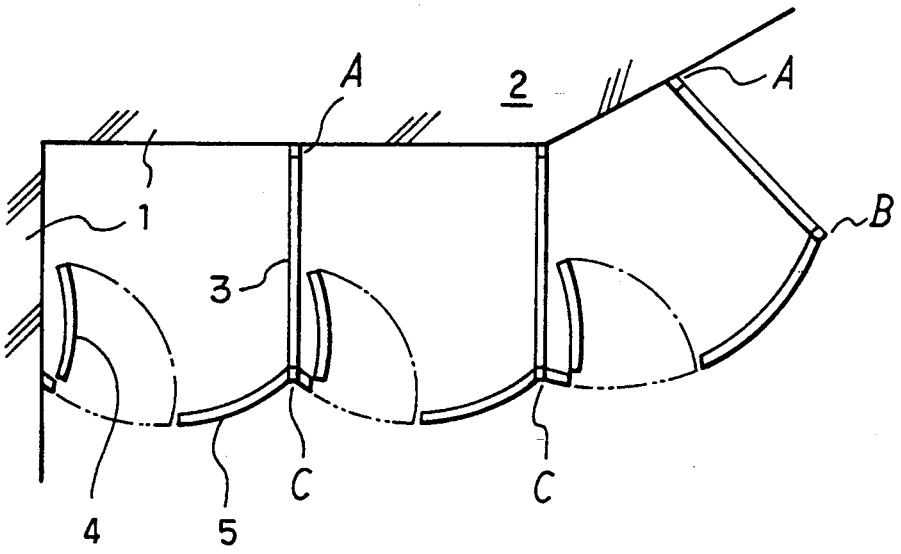
FIG. 1 is a schematic plan view showing an example of the invention.

FIG. 1 is a schematic plan view showing an application of this invention to the toilet booths where the booths are installed beginning from right angled walls 1 wall 2 which abuts wall 1 at an angle greater that 90°.

The instant toilet booth comprises a partition 3 such as the panel plate or the like, the door 4 and the curved front plate panel 5A. The door 4 is outwardly curved appropriately, a protruded portion of which does not interfere with anything, since outside of the booth is generally an enough space. Of course, the door 4 may be opened either outwardly or inwardly.

Figure 2:
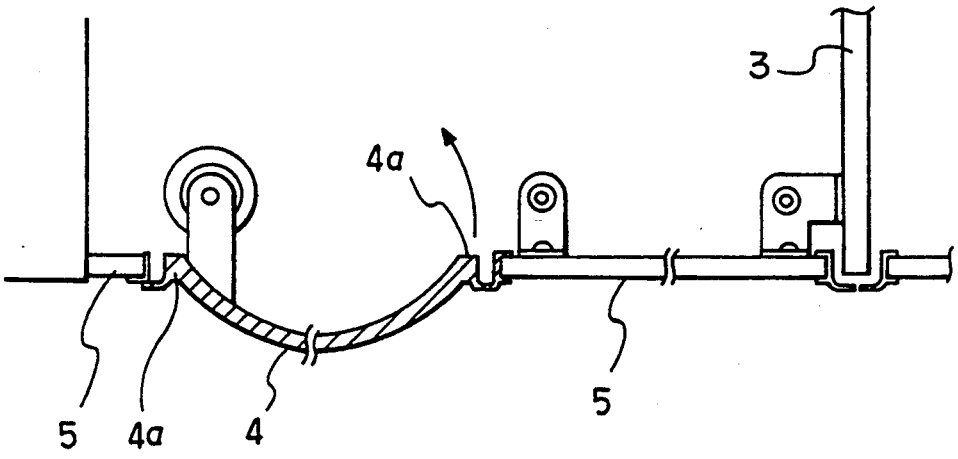
FIG. 2 is a detailed plan view of the above figure, partially in section.
Figure 4:
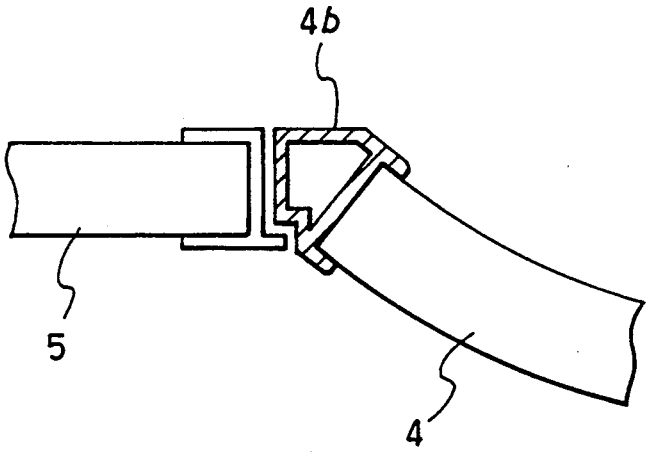
FIG. 4 is a view showing an example of connecting the door and the front plate panel.

In an example shown in FIG. 2, only the door 4 is curved and the front plate panel 5B is flat. In this case, both side ends **4*a* of the door 4 may be, as shown, formed flat for attaching hinges and locks thereto in a conventional manner. However, taking manufacturing conveniences and costs into consideration, an aluminium frame 4*b* of a special shape as seen in FIG. 4 is preferably provided for interconnecting the panel 5B and the door 4**.

Figure 3:
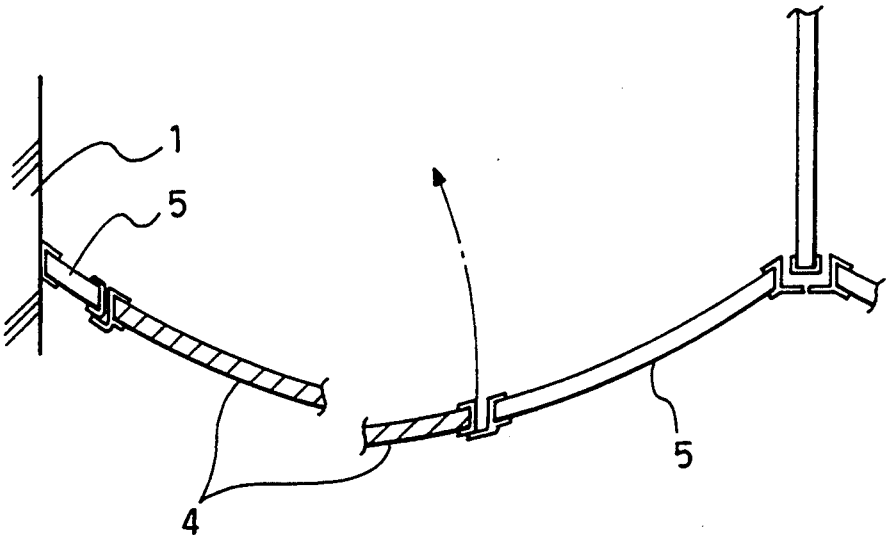
FIG. 3 is a detailed plan view of another embodiment.

In examples shown in FIGS.1 and 3, not only is the door 4 curved but also the front plate panel 5A is curved outwardly, following the curved surface of the former.

The curved arrangement of the door 4 and the front plate panel 5A is suited to be installed in front of walls 1 and 2 as seen in FIG. 1. Namely, since the toilet booths according to the invention are at least partially curved on the front faces, the faces can be installed in a manner to camouflage to a certain extent different abutting angles in the walls behind them while still effectively utilizing the space between the walls and the front faces.

Figure 7:
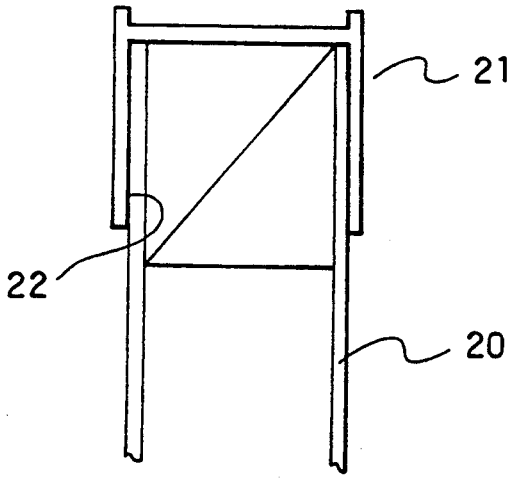
FIG. 7 (PRIOR ART)
FIG. 7 is a view showing a conventional aluminium frame.

To enable installation of a booth along walls which abut at different angles, the present invention makes use of a specially composed aluminium frame for connecting the front plate panel 5 and the partition 3. In conventionally used aluminium frames as shown in FIG. 7, a board 20 is face-contacted to a wall 22 within an inserting part of an aluminium frame 21, whereby the board 20 cannot be rotated with respect to the aluminium frame 21.

In contrast, aluminium frames 7, 8 and 9 employed in this invention, have horizontal projecting flanges 10 provided within each frame which permit positioning or rotating of a partition 3 or plate 5 in line contact with the flanges 10 at various angles to the side walls of the frames 7, 8 and 9 because of the space provided between such side walls and the partition due to horizontal projecting flanges 10. Accordingly, as shown in FIG. 5A, plate 3 and partition 5 can be rotated with respect to their corresponding aluminium frame within a limited range.

Figure 5A:
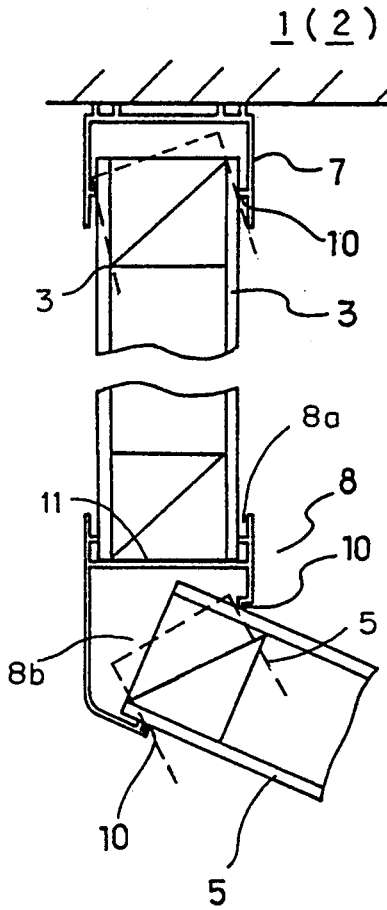
FIG. 5(A) and (B) are views showing aluminium frames to be utilized in this invention.

As shown in FIG. 5A, aluminium frame 7 is fixed to the wall face and supports the partition 3 ("A" part of FIG. 1) when the edge 12 of the partition 3 is inserted through and between horizontal projecting flanges 10.

Figure 5B:
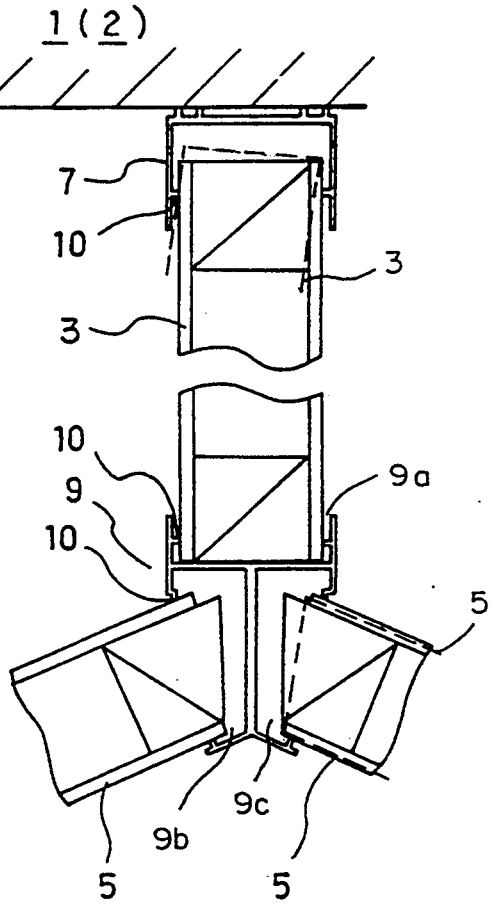
Figure 6:
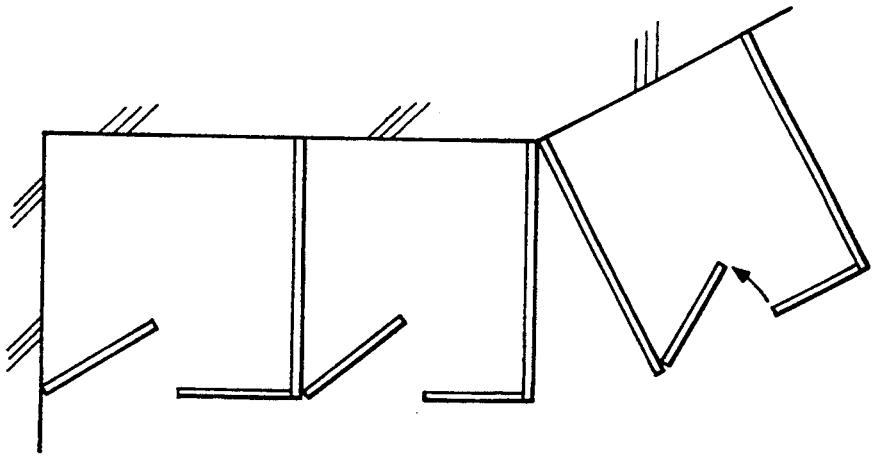
FIG. 6 (PRIOR ART)
FIG. 6 is a view explaining installation of the conventional booth to the differently shaped wall.

As shown in FIG. 5A aluminium frame 8 connects the partition 3 and the front plate panel 5 ("B" part of FIG. 1), and has two board inserting parts 8*a*; 8*b*. The partition 3 is inserted into inserting part 8*a*, and in this case, since the partition 3 does not need to be rotated, this inserting part 8*a* is short and the partition 3 can be inserted until its edged inner wall 11 of frame 8. Inserting part 8*b* is angled, so that the front plate panel 5 may be inserted in an oblique direction with respect to the partition 3. For changing the angle of the front plate panel 5, the panel 5 can be slightly pulled and rotated (as shown by imaginary lines in FIG. 5A. The angle of rotation of panel 3 and panel 5 shown by imaginary lines in FIG. 5A and 5B is exaggerated to emphasize the ability to rotate the panels within frames 7, 8 and 9. As shown in the drawings rotation is clearly limited by the space between opposite flanges 10 and the side walls and elasticity of aluminum frames 7, 8 and 9 in combination with the width of panels 3 and 5.

As shown in FIG. 5B aluminium frame 9 connects the partition 3 and the two front plate panels 5 ("C" part of FIG. 1), and has inserting parts 9*a*, 9*b* and 9*c* for three directions. One inserting part 9*a* of frame 9 is of the same structure as the inserting part 8*a*. Second and third inserting parts 9*b* and 9*c* of frame 9 open in right and left oblique directions in opposition to the inserting part 9*a*.

In the above described examples, the door is curved, and further, the whole of the door is curved. However, the partitions may be curved, and one part of the door and others may be curved. Furthermore, the booth according to the present invention is not necessarily limited to such an embodiment utilizing the wall surfaces as illustrated, an arrangement in which poles stand to form a rigid structure and the like may be adopted.

In the enlarged space created by the booth according to the present invention, hooks for hats, cloths and others, shelves or the like for magazines, small personal belongings and others may be provided, and as the case may be, televisions or radios may be positioned. In the door opening inward, there is an advantage that a toilet paper holder or the like to be furnished to the wall can be shielded therebehind not to interfere with the door. Besides, in the curved door, there is such a merit further emphasizing characteristics as luster and the like of surface covering materials, and highly improving mechanical strength.

What is claimed is;

1. An improvement for toilet booths for toilets in a toilet room sectioned into a plurality of said booths assembled along abutting walls of said toilet room by means of multiple doors, panels and partitions to define an interior space for each of said booths, each door being hinged to one of said panels at a front of each booth, respectively, the improvement comprising:

each said door having a curvature away from said front to enlarge said interior space;

first frame means for mounting each of said partitions, respectively, against a wall of said abutting walls, said first frame means permitting rotation of said one of said partitions about a vertical axis relative to said wall of said abutting walls; and second frame means for engaging each of said partitions, respectively, said second frame means further engaging said one of said panels and a second of said panels, respectively, said second frame means permitting rotation of said one of said panels and said second of said panels about a vertical axis relative to said abutting walls.

2. The improvement for toilet booths for toilets of claim 1 wherein each of said first frame means includes two vertical walls spaced apart to form a slot wider than a thickness of said partition, each of said vertical walls having a flange connected thereto projecting into said slot, said flanges engaging said partition to thereby permit said rotation about said vertical axis relative to said abutting walls.

3. The improvement for toilet booths for toilets of claim 1 wherein each of said panels has a curvature away from said front.

4. The improvement for toilet booths for toilets of claim 3 wherein said curvature of said panels is the same as said curvature of said doors.

5. The improvement for toilet booths for toilets of claim 1 wherein each of said panels is flat.

* * * * *